US008561267B2

(12) United States Patent
Chang

(10) Patent No.: US 8,561,267 B2
(45) Date of Patent: Oct. 22, 2013

(54) COMPOSITE-MATERIAL BUCKLE

(75) Inventor: Wen Cheng Chang, Changhua (TW)

(73) Assignee: Win Chance Metal Co., Ltd., Changhua (TW)

( * ) Notice: Subject to any disclaimer, the term of this patent is extended or adjusted under 35 U.S.C. 154(b) by 97 days.

(21) Appl. No.: 13/351,002

(22) Filed: Jan. 16, 2012

(65) Prior Publication Data

US 2013/0180085 A1 Jul. 18, 2013

(51) Int. Cl.
*A44B 99/00* (2010.01)

(52) U.S. Cl.
USPC ..... 24/499; 24/521; 24/67.3; 211/89.01

(58) Field of Classification Search
None
See application file for complete search history.

(56) References Cited

U.S. PATENT DOCUMENTS

| | | | | | |
|---|---|---|---|---|---|
| 236,242 | A * | 1/1881 | Newth | 24/511 |
| 718,418 | A * | 1/1903 | Bloom et al. | 24/504 |
| 1,176,586 | A * | 3/1916 | Megahan | 24/499 |
| 2,817,989 | A * | 12/1957 | Nowak | 81/362 |
| 3,030,681 | A * | 4/1962 | Phillips | 248/229.15 |
| 3,338,540 | A * | 8/1967 | Barish | 248/212 |
| 3,670,742 | A * | 6/1972 | Weaner | 132/216 |
| 4,228,569 | A * | 10/1980 | Snyder | 24/489 |
| 4,840,341 | A * | 6/1989 | Hasegawa | 248/316.5 |
| 5,079,808 | A * | 1/1992 | Brown | 24/67.7 |
| 5,179,768 | A * | 1/1993 | Jio | 24/545 |
| 5,301,393 | A * | 4/1994 | Brown | 24/67.7 |
| 5,361,463 | A * | 11/1994 | Revis | 24/543 |
| 6,213,190 | B1 * | 4/2001 | Hannerstig | 160/349.2 |
| 6,397,439 | B1 * | 6/2002 | Langford | 24/518 |
| 7,559,125 | B2 * | 7/2009 | Cofer | 24/487 |
| 2008/0092349 | A1 * | 4/2008 | Cofer | 24/487 |
| 2008/0148529 | A1 * | 6/2008 | Huang | 24/170 |

* cited by examiner

*Primary Examiner* — Jack W. Lavinder
(74) *Attorney, Agent, or Firm* — Alan Kamrath; Kamrath IP Lawfirm, P.A.

(57) ABSTRACT

A composite-material buckle contains a base including a first segment with an engaging face and a second segment, between the first segment and the second segment being defined two side walls having two symmetrical holes and two symmetrically elongated pivoting portions respectively; a shaft including two ends inserted into the two symmetrical holes respectively; a plastic press member including a pressing portion and an actuating portion secured, and between the pressing portion and the actuating portion being defined a through aperture, the plastic press member including an elastic arm; a metal member connected with the pressing portion of the plastic press member so that the metal member covers the pressing portion and contacts with the engaging face of the base, and the metal member including a number of retaining teeth arranged thereon.

7 Claims, 6 Drawing Sheets

FIG. 3

COMPOSITE-MATERIAL BUCKLE

BACKGROUND OF THE INVENTION

1. Field of the Invention

The present invention relates to a buckle to match with a rope for binding cargo on vehicles or pallets, and more particularly to a composite-material buckle.

2. Description of the Prior Art

Referring to FIG. 1, a conventional buckle is comprised of a base 60, an shaft 70, a press member 80 hot forged, and a torsion spring 90, the base 60 is formed in a U-shape and includes an engaging face 61, the shaft 70 is inserted through the press member 80 and the torsion spring 90 to position on the base 60, the press member 80 includes a pressing portion 81 disposed on one end thereof to correspond to the engaging face 61 and includes an actuating portion 82 fixed on another end thereof, the pressing portion 81 of the press member 80 is pushed to abut against the engaging face 61 by using the torsion spring 90.

However, a manufacture process for the conventional buckle has the following defects:

1. The conventional buckle is provided with the torsion spring 90 to increase production cost except the base 60, the shaft 70, and the press member 80 hot forged.

2. In assembly, the torsion spring 90 is twisted to generate a torque on the base 60 and the press member 80, and the shaft 70 is inserted through the base 60, having complicated assembly and high assembly cost.

3. The press member 80 is hot forged, having poor production efficiency and working cost.

The present invention has arisen to mitigate and/or obviate the afore-described disadvantages.

SUMMARY OF THE INVENTION

The primary object of the present invention is to provide a composite-material buckle of which a plastic press member includes an elastic arm directly formed thereon to eliminate a conventional spring, lowering production cost.

Further object of the present invention is to provide a composite-material buckle of which the plastic press member includes the elastic arm directly formed thereon, so after the plastic press member is fixed, the elastic arm is biased against a base resiliently, having easy and quick production and lowering production cost.

Another object of the present invention is to provide a composite-material buckle of which the plastic press member is injection molded from plastic material, thereby having lower production cost than that of the conventional press member which is hot forged in a metal working process.

To obtain the above objectives, a composite-material buckle contains:

a base including a first segment and a second segment, the second segment including an engaging face, between the first segment and the second segment being defined two side walls, the two side walls having two symmetrical holes and two symmetrically elongated pivoting portions respectively;

a shaft including two ends inserted into the two symmetrical holes of the two side walls respectively;

a plastic press member including a pressing portion disposed on one end thereof to match with the engaging face and an actuating portion secured on another end thereof, and between the pressing portion and the actuating portion being defined a through aperture of the plastic press member to insert the shaft so that the plastic press member is fixed between the two sides, and the plastic press member including an elastic arm integrally extending therefrom to abut against the two symmetrically elongated pivoting portions of the base so that the actuating portion of the plastic press member keeps in a raised state normally, and the elastic arm extending outward from the actuating portion in a direction where is adjacent to the base;

a metal member connected with the pressing portion of the plastic press member so that the metal member covers the pressing portion and contacts with the engaging face of the base, and the metal member including a number of retaining teeth arranged thereon.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
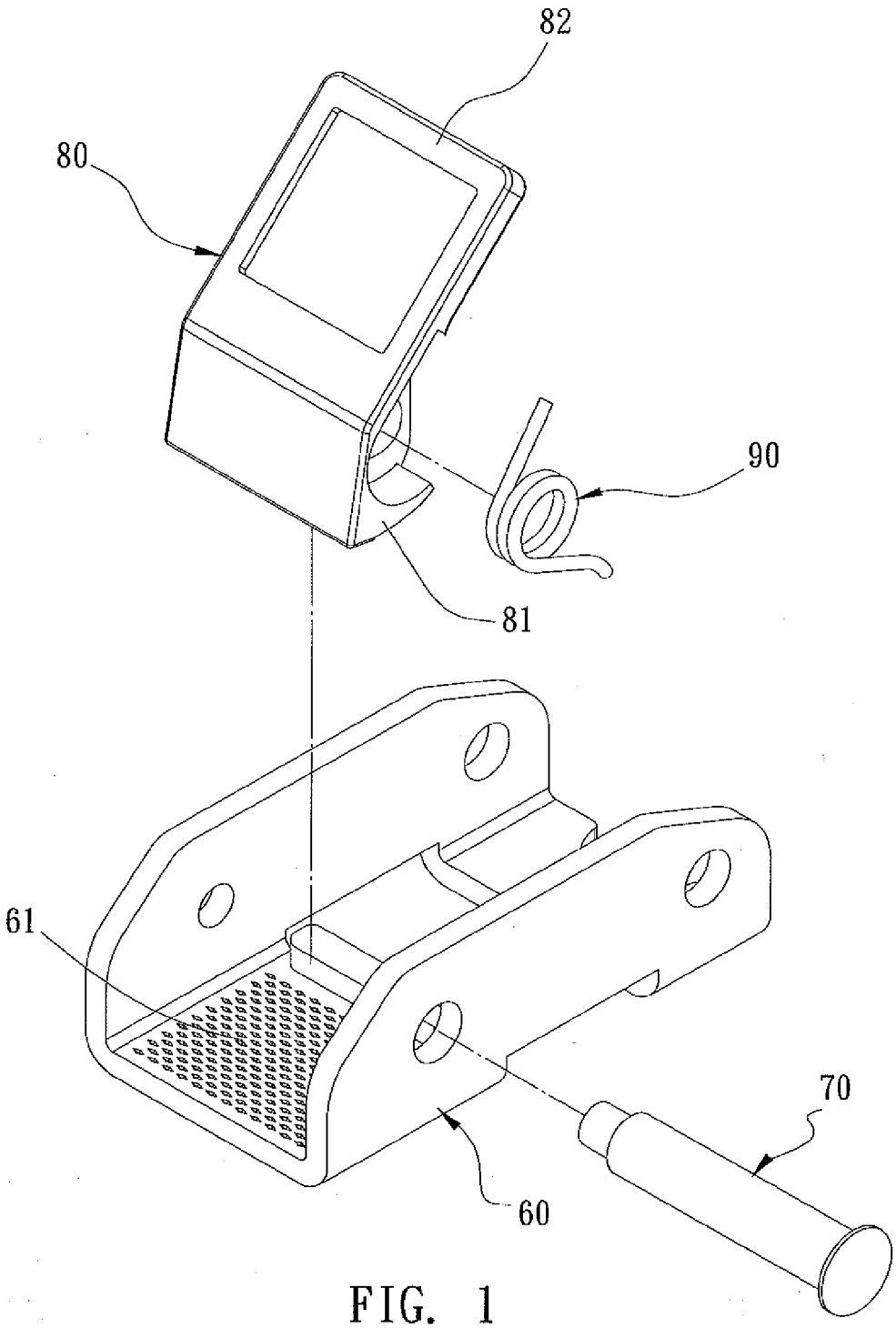
FIG. 1 PRIOR ART
FIG. 1 is a perspective view of a conventional buckle.
Figure 2:
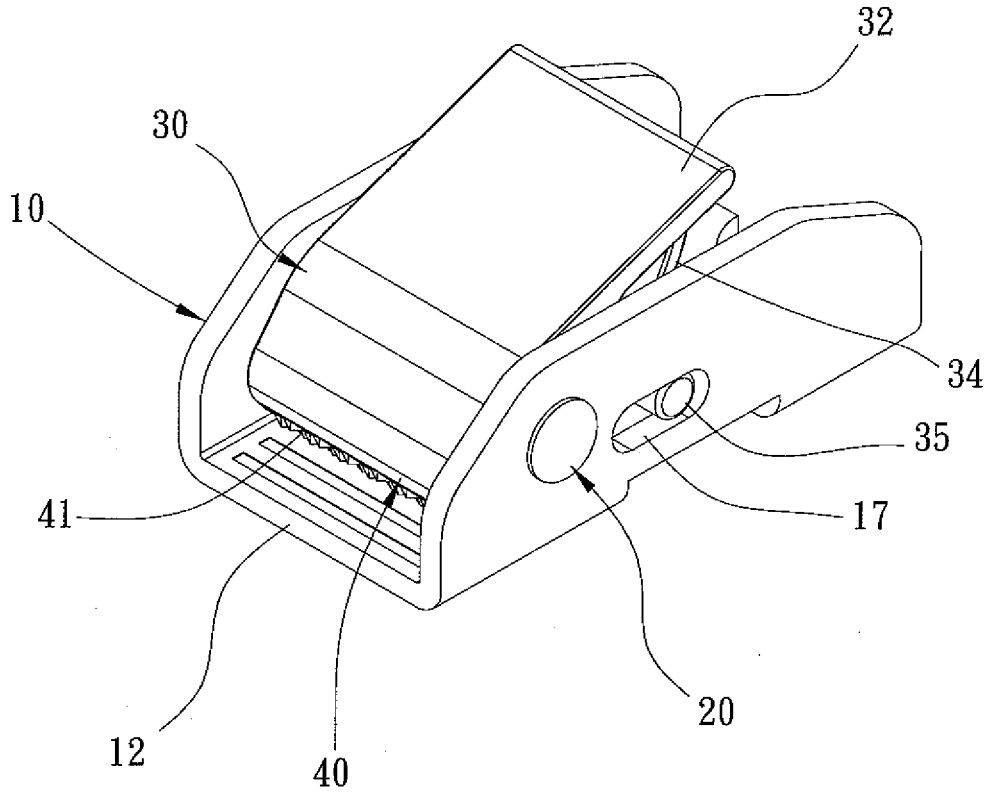
FIG. 2 is a perspective view showing the assembly of a composite-material buckle according to a preferred embodiment of present invention.
Figure 3:
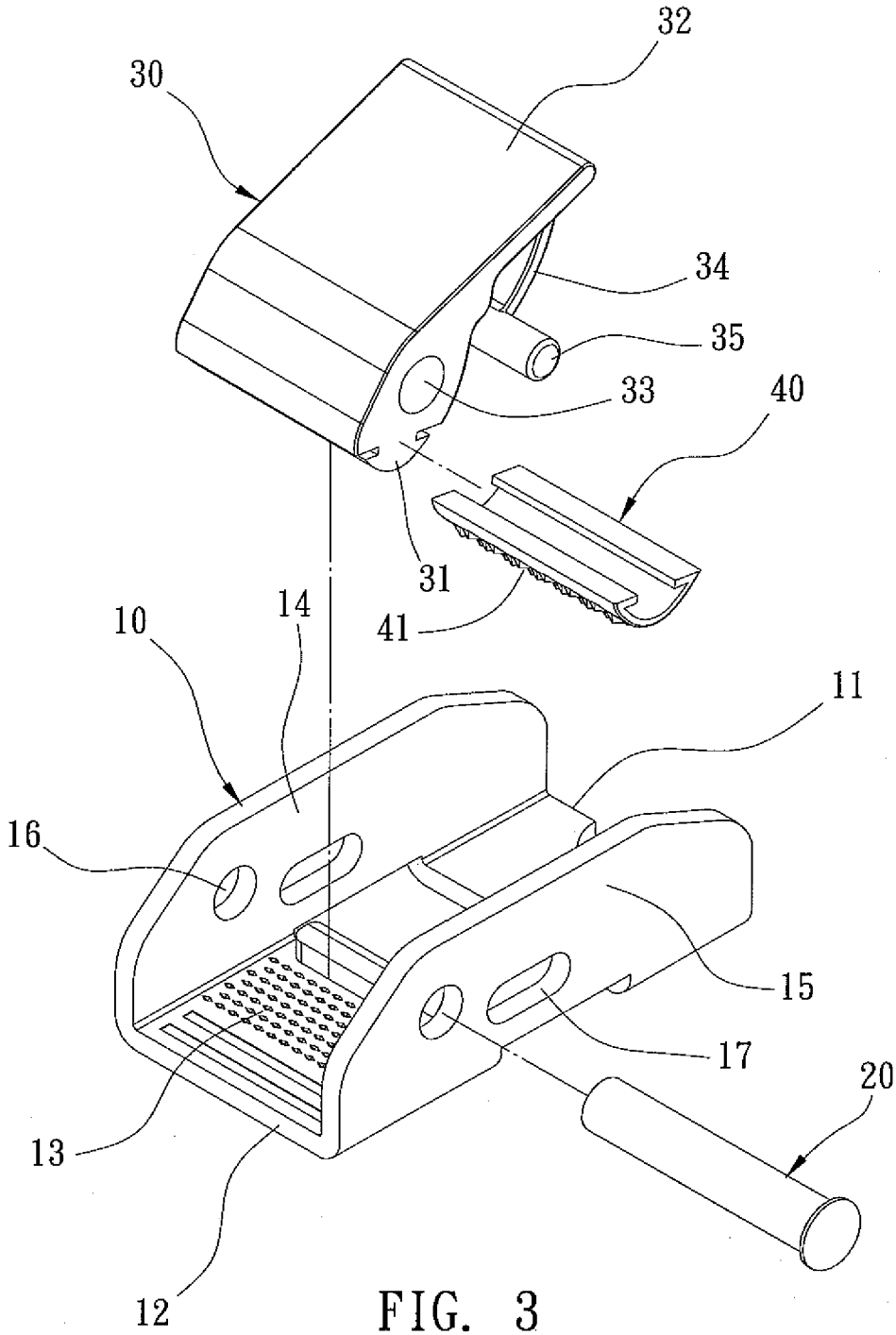
FIG. 3 is a perspective view showing the exploded components of the composite-material buckle according to the preferred embodiment of present invention.

Referring to FIGS. 2-3, a composite-material buckle comprises a base 10, a shaft 20, a plastic press member 30, and a metal member 40.

Figure 5:
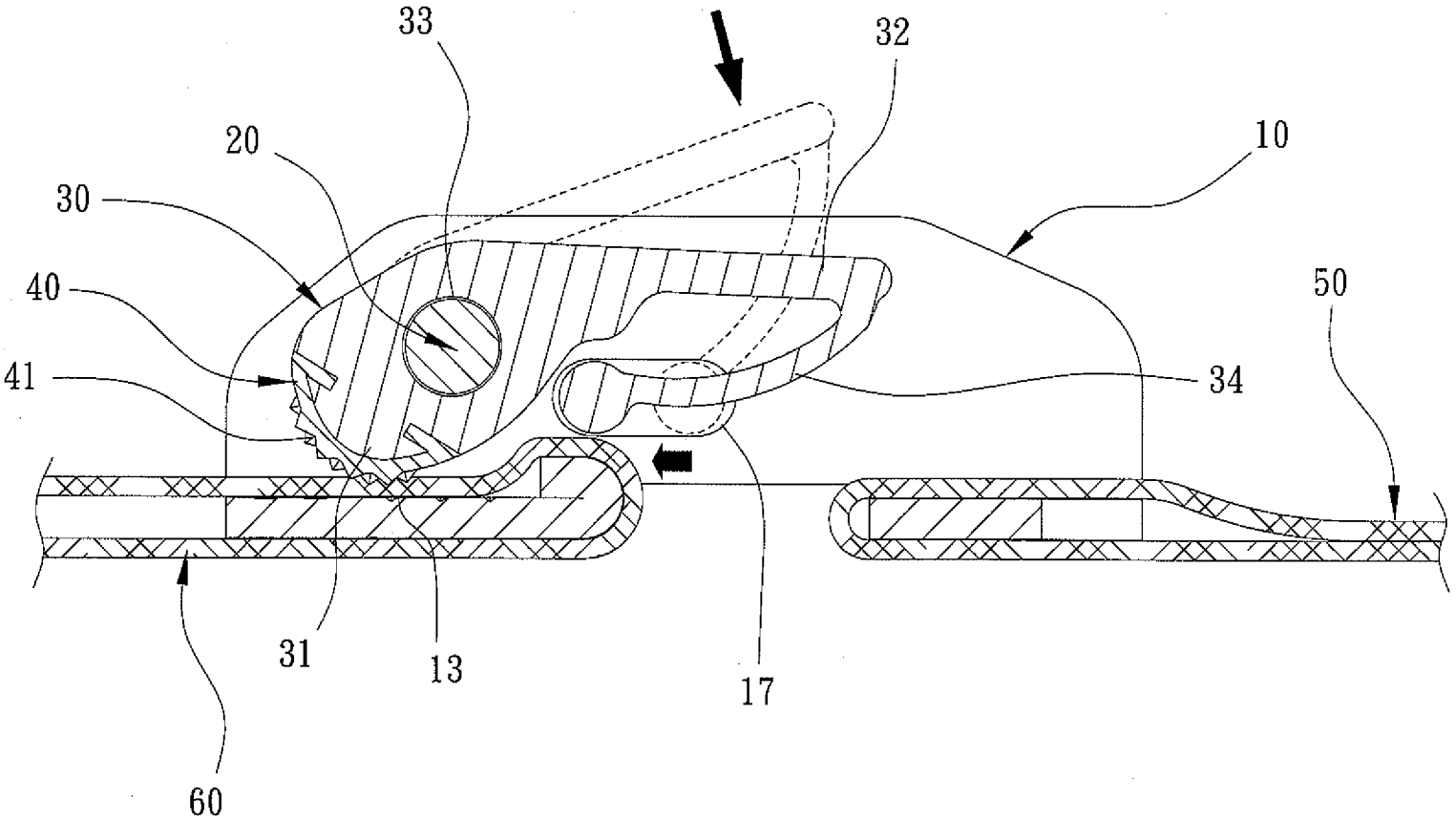
FIG. 5 is a cross sectional view showing the operation of the composite-material buckle according to the preferred embodiment of present invention.

The base 10 includes a first segment 11 and a second segment 12, the first segment 11 is used to fix a fixed rope 50 (as shown in FIG. 5), the second segment 12 includes an engaging face 13 to insert a movable rope 60 (as illustrated in FIG. 5), the movable rope 60 passes through the engaging face 13, between the first segment 11 and the second segment 12 are defined two side walls 14, 15, the two side walls 14, 15 have two symmetrical holes 16 and two symmetrically elongated pivoting portions 17 respectively, it is preferred that the two symmetrically elongated pivoting portions 17 are in communication with the two symmetrically elongated pivoting portions 14, 15 individually.

The shaft 20 includes two ends inserted into the two symmetrical holes 16 of the two side walls 14, 15 respectively.

Figure 4:
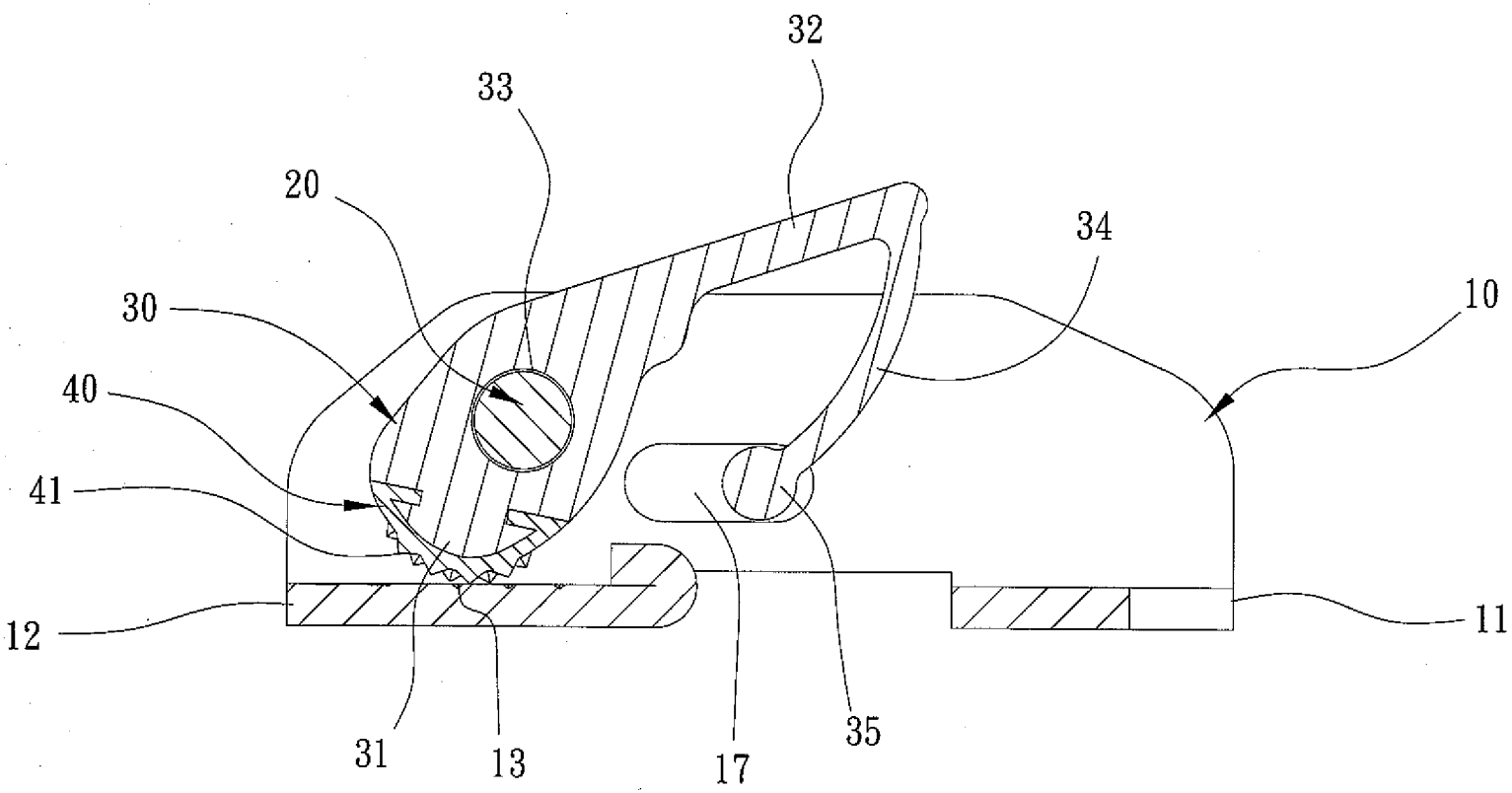
FIG. 4 is a cross sectional view showing the assembly of the composite-material buckle according to the preferred embodiment of present invention.
Figure 6:
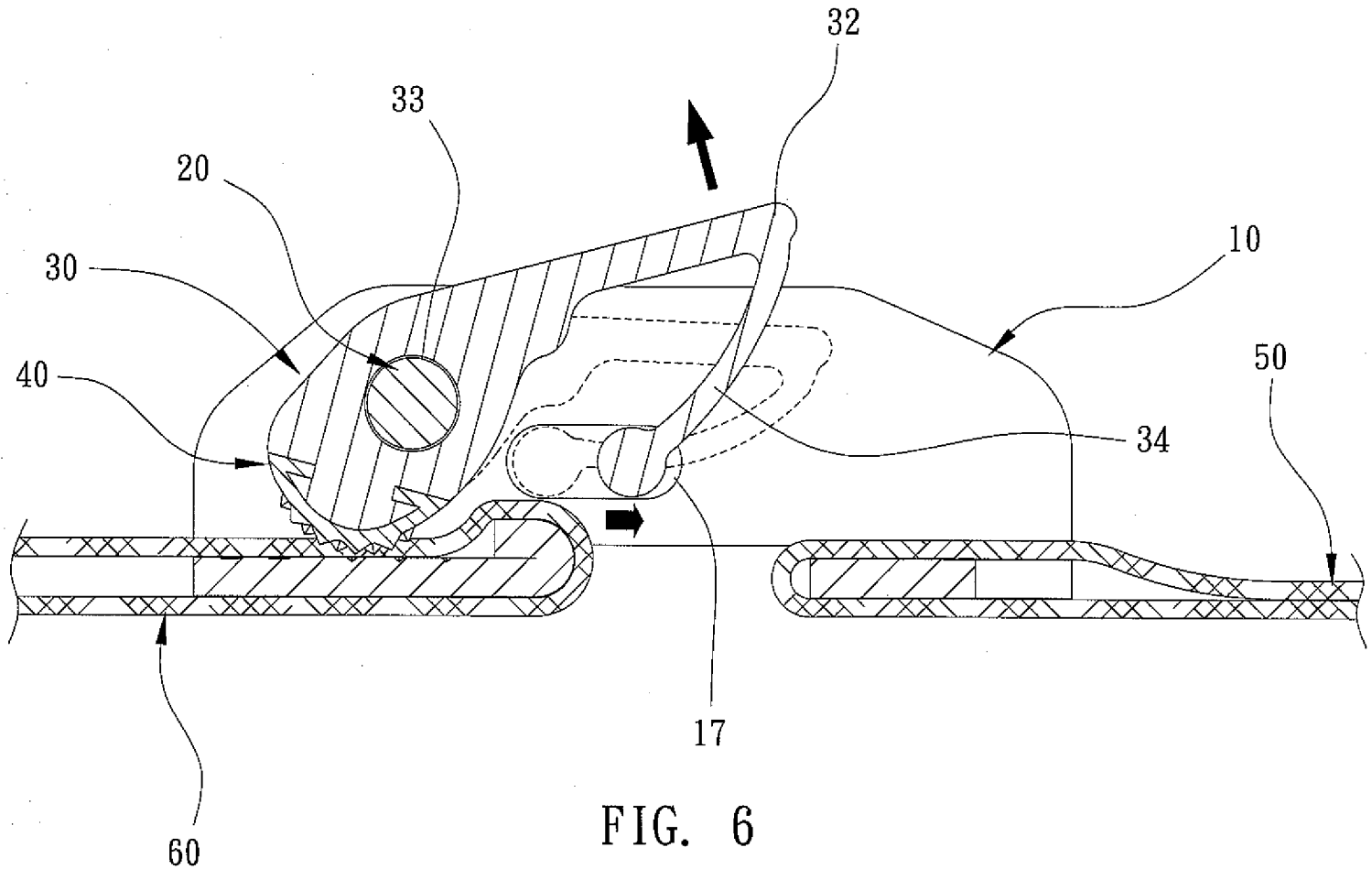
FIG. 6 is another cross sectional view showing the operation of the composite-material buckle according to the preferred embodiment of present invention.

The plastic press member 30 includes a pressing portion 31 disposed on one end thereof to match with the engaging face 13 and an actuating portion 32 secured on another end thereof, and between the pressing portion 31 and the actuating portion 32 is defined a through aperture 33 of the plastic press member 30 to insert the shaft 20 so that the plastic press member 30 is fixed between the two sides 14, 15, and the plastic press member 30 includes an elastic arm 34 integrally extending therefrom to abut against the two symmetrically elongated pivoting portions 17 of the base 10 so that the actuating portion 32 of the plastic press member 30 keeps in a raised state normally, and the pressing portion 31 contacts with the engaging face 13 and the movable rope 60, wherein the elastic arm 34 extends outward from the actuating portion 32 in a direction where is adjacent to the base 10, the elastic arm 34 includes a guiding post 35 extending outward thereon and displacing on the two symmetrically elongated pivoting portions 17, when the actuating portion 32 is pressed downward, the elastic arm 34 is pressed resiliently, and the pressing portion 31 disengages from the engaging face 13 and releases the movable rope 60 (as shown in FIGS. 4-6).

The metal member 40 is connected with the pressing portion 31 of the plastic press member 30 so that the metal member 40 covers the pressing portion 31 and contacts with the engaging face 13 of the base 10, and the metal member 40 includes a number of retaining teeth 41 arranged thereon, the plastic press member 30 is connected with the metal member 40 in a built-in injecting manner, an insertion retaining manner, or an adhering manner, so the metal member 40 is connected with the plastic press member 30, thus increasing contacting strength between the plastic press member 30 and the movable rope 60.

Thereby, the composite-material buckle has the following advantages:

1. The plastic press member 30 includes the elastic arm 34 directly formed thereon to eliminate a conventional spring, lowering production cost.

2. The plastic press member 30 includes the elastic arm 34 directly formed thereon, so after the plastic press member 30 is fixed, the elastic arm 34 is biased against the base 10 resiliently, having easy and quick production and lowering production cost.

3. The plastic press member 30 is injection molded from plastic material, thereby having lower production cost than that of the conventional press member which is hot forged in a metal working process.

While we have shown and described various embodiments in accordance with the present invention, it is clear to those skilled in the art that further embodiments may be made without departing from the scope of the present invention.

What is claimed is:

1. A composite-material buckle comprising: a base, a shaft, a plastic press member, and a metal member;

the base including a first segment and a second segment, the second segment including an engaging face, between the first segment and the second segment being defined two side walls, the two side walls having two symmetrical holes and two symmetrically elongated pivoting portions respectively;

the shaft including two ends inserted into the two symmetrical holes of the two side walls respectively;

the plastic press member including a pressing portion disposed on one end thereof to match with the engaging face and an actuating portion secured on another end thereof, and between the pressing portion and the actuating portion being defined a through aperture of the plastic press member to insert the shaft so that the plastic press member is fixed between the two sides, and the plastic press member including an elastic arm integrally extending therefrom to abut against the two symmetrically elongated pivoting portions of the base so that the actuating portion of the plastic press member keeps in a raised state normally, and the elastic arm extending outward from the actuating portion in a direction and is adjacent to the base;

the metal member connected with the pressing portion of the plastic press member so that the metal member covers the pressing portion and contacts with the engaging face of the base, and the metal member including a number of retaining teeth arranged thereon.

2. The composite-material buckle as claimed in claim 1, wherein the first segment of the base is used to fix a fixed rope, the second segment includes an engaging face to insert a movable rope, the movable rope passes through the engaging face.

3. The composite-material buckle as claimed in claim 1, wherein the two symmetrically elongated pivoting portions communicate with the two side walls individually.

4. The composite-material buckle as claimed in claim 1, wherein the elastic arm includes a guiding post extending outward thereon and displacing on the two symmetrically elongated pivoting portions.

5. The composite-material buckle as claimed in claim 1, wherein the plastic press member is connected with the metal member in a built-in injecting manner.

6. The composite-material buckle as claimed in claim 1, wherein the plastic press member is connected with the metal member in an insertion retaining manner.

7. The composite-material buckle as claimed in claim 1, wherein the plastic press member is connected with the metal member in an adhering manner.

* * * * *